US009332339B2

(12) United States Patent
Oliveira

(10) Patent No.: US 9,332,339 B2
(45) Date of Patent: May 3, 2016

(54) MULTI-PIN AUDIO PLUG WITH RETRACTABLE NUB

(71) Applicant: QUALCOMM Incorporated, San Diego, CA (US)

(72) Inventor: Louis Dominic Oliveira, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 337 days.

(21) Appl. No.: 13/784,589

(22) Filed: Mar. 4, 2013

(65) Prior Publication Data

US 2014/0098969 A1 Apr. 10, 2014

Related U.S. Application Data

(60) Provisional application No. 61/710,439, filed on Oct. 5, 2012.

(51) Int. Cl.
*H04R 1/10* (2006.01)
*H01R 24/58* (2011.01)
*H01R 27/00* (2006.01)

(52) U.S. Cl.
CPC ..... *H04R 1/1083* (2013.01); *H01R 24/58* (2013.01); *H01R 27/00* (2013.01)

(58) Field of Classification Search
CPC ..... H04R 27/00
USPC ..... 381/74, 384; 439/131, 171, 172, 668, 439/669
See application file for complete search history.

(56) References Cited

U.S. PATENT DOCUMENTS

| | | | | |
|---|---|---|---|---|
| 3,890,030 | A * | 6/1975 | McDaniel | 439/490 |
| 5,857,866 | A | 1/1999 | Felps | |
| 6,461,199 | B1 | 10/2002 | Koga et al. | |
| 6,991,497 | B1 | 1/2006 | Lin | |
| 7,824,228 | B1 * | 11/2010 | Yang | H01R 13/41 439/668 |
| 8,197,267 | B2 | 6/2012 | Kuo | |
| 2007/0049103 | A1 * | 3/2007 | Kashi et al. | 439/396 |
| 2007/0072649 | A1 | 3/2007 | Park | |

(Continued)

FOREIGN PATENT DOCUMENTS

| | | | |
|---|---|---|---|
| EP | 1898665 | A2 | 3/2008 |
| GB | 2241840 | A | 9/1991 |
| JP | H04149978 | A | 5/1992 |
| JP | H09204966 | A | 8/1997 |

OTHER PUBLICATIONS

Machine Translation of Japanese Publication No. 09-204966, Aug. 5, 1997.*

(Continued)

*Primary Examiner* — Paul S Kim
*Assistant Examiner* — Katherine Faley
(74) *Attorney, Agent, or Firm* — Knobbe Martens Olson & Bear LLP

(57) ABSTRACT

Flexible connectors that can be mated into specially designed electronic receptacles are described. In some embodiments, additional connections on the connector can make contact with the receptacle. However, the additional connections are also provided in a manner wherein if the connector is plugged into a legacy, conventional receptacle, the additional connectors become disengaged and slide away from, back from, or inside the jack so that the connector can still be used on legacy devices.

16 Claims, 12 Drawing Sheets

(56) References Cited

U.S. PATENT DOCUMENTS

| | | | | |
|---|---|---|---|---|
| 2007/0177741 | A1 | 8/2007 | Williamson | |
| 2008/0175402 | A1* | 7/2008 | Abe et al. | 381/71.6 |
| 2008/0226091 | A1* | 9/2008 | Matsumoto et al. | 381/71.1 |
| 2009/0196454 | A1* | 8/2009 | Her et al. | 381/380 |
| 2010/0266134 | A1* | 10/2010 | Wertz et al. | 381/71.1 |
| 2010/0322441 | A1 | 12/2010 | Weiss et al. | |

OTHER PUBLICATIONS

International Search Report and Written Opinion—PCT/US2013/062681—ISA/EPO—Feb. 17, 2014.

Partial International Search Report—PCT/US2013/062681—ISA/EPO—Dec. 4, 2013.

* cited by examiner

MULTI-PIN AUDIO PLUG WITH RETRACTABLE NUB

CROSS-REFERENCE TO RELATED APPLICATIONS

The application claims the priority benefit of U.S. Provisional Application No. 61/710,439, entitled "MULTI-PIN PLUG WITH EXPANSION NUB," filed Oct. 5, 2012.

TECHNICAL FIELD

The systems and methods disclosed herein relate generally to device connectors, and more particularly, to device connectors that include expansion portions for connecting to multiple receptacles.

BACKGROUND

Many activities that were previously performed in quiet office or home environments are being performed today in acoustically variable situations like a car, a street, or a cafe. For example, a person may desire to communicate with another person using a voice communication channel. The channel may be provided, for example, by a mobile wireless handset or headset, a walkie-talkie, a two-way radio, a car-kit, or another communications device. Consequently, a substantial amount of voice communication is taking place using mobile devices (e.g., smartphones, handsets, and/or headsets) in environments where users are surrounded by other people, with the kind of noise content that is typically encountered where people tend to gather. Such noise tends to distract or annoy a user at the far end of a telephone conversation. Moreover, many standard automated business transactions (e.g., account balance or stock quote checks) employ voice recognition based data inquiry, and the accuracy of these systems may be significantly impeded by interfering noise.

For applications in which communication occurs in noisy environments, it may be desirable to separate a desired speech signal from background noise. Noise may be defined as the combination of all signals interfering with or otherwise degrading the desired signal. Background noise may include numerous noise signals generated within the acoustic environment, such as background conversations of other people, as well as reflections and reverberation generated from the desired signal and/or any of the other signals. Unless the desired speech signal is separated from the background noise, it may be difficult to make reliable and efficient use of it. In one particular example, a speech signal is generated in a noisy environment, and speech processing methods are used to separate the speech signal from the environmental noise.

Noise encountered in a mobile environment may include a variety of different components, such as competing talkers, music, babble, street noise, and/or airport noise. As the signature of such noise is typically nonstationary and close to the user's own frequency signature, the noise may be hard to suppress using traditional single microphone or fixed beamforming type methods. Single microphone noise reduction techniques typically suppress only stationary noises and often introduce significant degradation of the desired speech while providing noise suppression. However, multiple-microphone-based advanced signal processing techniques are typically capable of providing superior voice quality with substantial noise reduction and may be desirable for supporting the use of mobile devices for voice communications in noisy environments.

Voice communication using headsets can be affected by the presence of environmental noise at the near-end. The noise can reduce the signal-to-noise ratio (SNR) of the signal being transmitted to the far-end, as well as the signal being received from the far-end, detracting from intelligibility and reducing network capacity and terminal battery life.

Active noise cancellation (ANC, also called active noise reduction) is a technology that actively reduces ambient acoustic noise by generating a waveform that is an inverse form of the noise wave (e.g., having the same level and an inverted phase), also called an "antiphase" or "anti-noise" waveform. An ANC system generally uses one or more microphones to pick up an external noise reference signal, generates an anti-noise waveform from the noise reference signal, and reproduces the anti-noise waveform through one or more loudspeakers. This anti-noise waveform interferes destructively with the original noise wave to reduce the level of the noise that reaches the ear of the user.

Active noise cancellation techniques may be applied to sound reproduction devices, such as headphones, and personal communications devices, such as cellular telephones, to reduce acoustic noise from the surrounding environment. In such applications, the use of an ANC technique may reduce the level of background noise that reaches the ear (e.g., by up to twenty decibels) while delivering useful sound signals, such as music and far-end voices.

SUMMARY

In order to address these considerations, embodiments disclosed herein relate to device connectors, particularly device connectors that include expansion portions for connecting to multiple receptacles.

In one embodiment, a plug configured to electrically connect an apparatus to a receptacle of a device includes a plug portion having a housing, an elongated stem and one or more electrical connections on the elongated stem, and a retractable nub positioned adjacent to the plug portion and having one or more electrical connections. The retractable nub is configured to move with respect to the plug portion when the plug portion is engaged into the receptacle.

In another embodiment, a plug configured to electrically connect an apparatus to a compatible receptacle of a device includes a plug portion having a housing, an elongated stem and one or more electrical connections on the elongated stem; and a retractable portion configured to retractably connect an electronic feature of the apparatus to devices having compatible receptacles. The retractable portion is configured to electrically connect with devices having compatible receptacles, and move with respect to the elongated stem when engaged with incompatible receptacles.

In yet another embodiment, a plug configured to electrically connect an apparatus to a compatible receptacle of a device includes means for making a first electrical connection with the receptacle, wherein the means comprises an elongated stem having one or more electrical connections, and means for retractably connecting an electronic feature of the apparatus to devices having compatible receptacles. The retractable means is configured to electrically connect with devices having compatible receptacles, and move with respect to the elongated stem when engaged with incompatible receptacles.

In one other embodiment, an electronic device configured to sense the presence of a compatible plug being connected to a receptacle includes a compatible receptacle that is configured to receive a legacy plug and an enhanced plug. The receptacle has a first cylindrical plug portion and a second plug portion adjacent the first cylindrical plug portion, at least one connector within the second plug portion, and a first signal detection module configured to detect a when the enhanced plug has been connected to the second plug portion.

In another embodiment, an apparatus includes a headphone member having a first earpiece and a second earpiece, the first earpiece having a first speaker and a first microphone, the second earpiece having a second speaker and a second microphone, and a plug operably connected to the headphone member having a first electrical connection configured to output a first signal, based on a signal captured by the first microphone, to an external electronic device, a second electrical connection configured to output a second signal, based on a signal captured by the second microphone, to the external electronic device, a third electrical connection configured to output a third signal, based on a signal captured by a third microphone, to the external electronic device. The first and second electrical connections are located on a retractable portion of the plug configured to retractably connect an electronic feature of the apparatus to devices having compatible receptacles, wherein the retractable portion is configured to electrically connect with devices having compatible receptacles, and move with respect to the elongated stem when engaged with incompatible receptacles.

In yet another embodiment, an apparatus includes a headphone member having a first earpiece and a second earpiece, the first earpiece having a first speaker and a first microphone, the second earpiece having a second speaker and a second microphone, and a plug operably connected to the headphone member having a first electrical connection configured to output a first signal, based on a signal captured by the first microphone, to an external electronic device, a second electrical connection configured to output a second signal, based on a signal captured by the second microphone, to the external electronic device, a third electrical connection configured to output a third signal, based on a signal captured by a third microphone, to the external electronic device, a fourth electrical connection configured to output a fourth signal to the external electronic device, and a fifth electrical connection configured to output a fifth signal to the external electronic device. The first, second, third, and fourth electrical connections are located on a retractable portion of the plug configured to retractably connect an electronic feature of the apparatus to devices having compatible receptacles, wherein the retractable portion is configured to electrically connect with devices having compatible receptacles, and move with respect to the elongated stem when engaged with incompatible receptacles.

DETAILED DESCRIPTION

System Overview

Figure 1A:
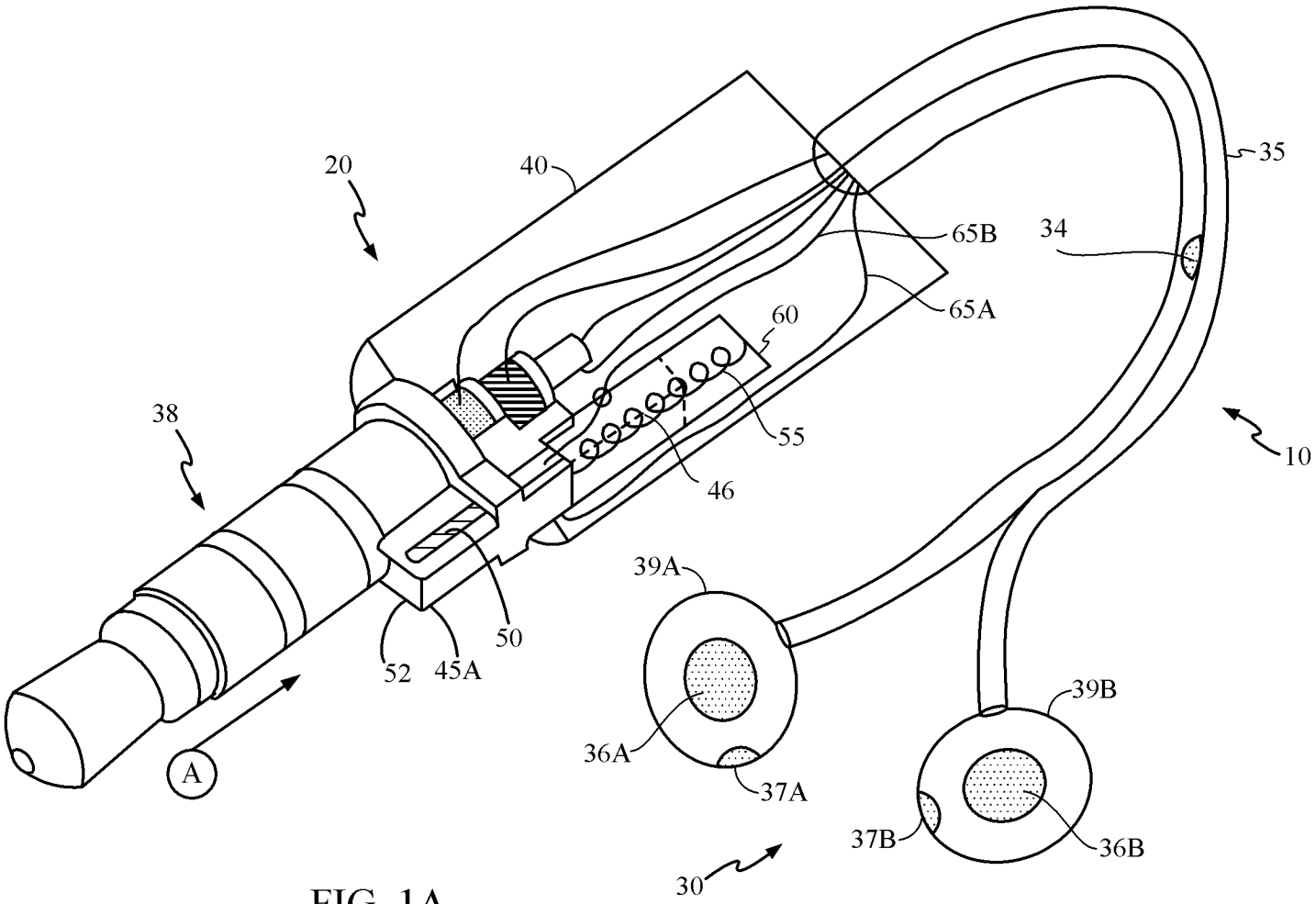
FIG. 1A is a perspective view of one embodiment of active noise cancelling headphones having a multi-pin headphone connector.

Embodiments of the invention relate to flexible connectors that can be mated into specially designed electronic receptacles and wherein additional connections on the connector can make contact with the receptacle. However, the additional connections are also provided in a manner wherein if the connector is plugged into a legacy, conventional receptacle, the additional connectors become disengaged and slide away from, back from, or inside the jack so that the connector can still be used on legacy devices.

In one embodiment, the flexible connector includes a conventional 3.5 mm plug portion that is configured to mate with conventional 3.5 mm receptacles that are found on many portable electronic devices. However, the flexible connector also includes a spring loaded slidably engaged nub portion that sits along the base of the connector and is configured to retract into the base portion if backwards pressure is placed onto the nub. Thus, the retractable nub is configured to move with respect to the plug portion when the plug portion is engaged into a receptacle. The nub portion can also include two side connections that are configured to slide inside of a rectangular shaped receiver within a custom receptacle such that the two side connections make contact with the matching connectors in the rectangular receiver in order to provide additional connections between the headphones and the device. This is explained more fully with respect to FIG. 1 which shows an exemplary noise cancelling headset.

A headset for use with a cellular telephone handset (e.g., a smartphone) typically contains a loudspeaker for reproducing the far-end audio signal at one of the user's ears and a primary microphone for receiving the user's voice. The loudspeaker is typically worn at the user's ear, and the microphone is arranged within the headset to be disposed during use to receive the user's voice with an acceptably high SNR. The microphone is typically located, for example, within a housing worn at the user's ear, on a boom or other protrusion that extends from such a housing toward the user's mouth, or on a cord that carries audio signals to and from the cellular telephone. Communication of audio information (and possibly control information, such as telephone hook status) between the headset and the handset may be performed over a link that is wired or wireless.

The headset may also include one or more additional secondary microphones at the user's ear, which may be used for improving the SNR in the primary microphone signal. Such a headset does not typically include or use a secondary microphone at the user's other ear for such purpose.

A stereo set of headphones or ear buds may be used with a portable media player for playing reproduced stereo media content. Such a device includes a loudspeaker worn at the user's left ear and a loudspeaker worn in the same fashion at the user's right ear. Such a device may also include, at each of the user's ears, a respective one of a pair of noise reference microphones that are disposed to produce environmental noise signals to support an ANC function. The environmental noise signals produced by the noise reference microphones are not typically used to support processing of the user's voice.

It should be realized that an electronic device may be configured to sense the presence of a compatible plug being connected to a receptacle. Thus, a device may have a compatible receptacle, as discussed below that is configured to receive a legacy plug and an enhanced plug. The legacy plug may be a conventional 3.5 mm headphone plug, or a 2.5 mm plug, that is matched to mate with a cylindrical portion of a receptacle in the electronic device. The enhanced plug may be a plug with a retractable nub portion and be configured to connect to a second plug portion that can be a connector having a square, cylindrical, cubic or rectangular receiving portion. In order for the electronic device to detect that an enhanced plug has been mated into a receptacle, the device may include a first signal detection module configured to detect a when the enhanced plug has been connected to the second plug portion. For example, first signal detection module may detect a change in voltage or resistance at the receptacle when the enhanced plug is connected to a second plug portion that mates with the retractable nub.

Figure 1B:
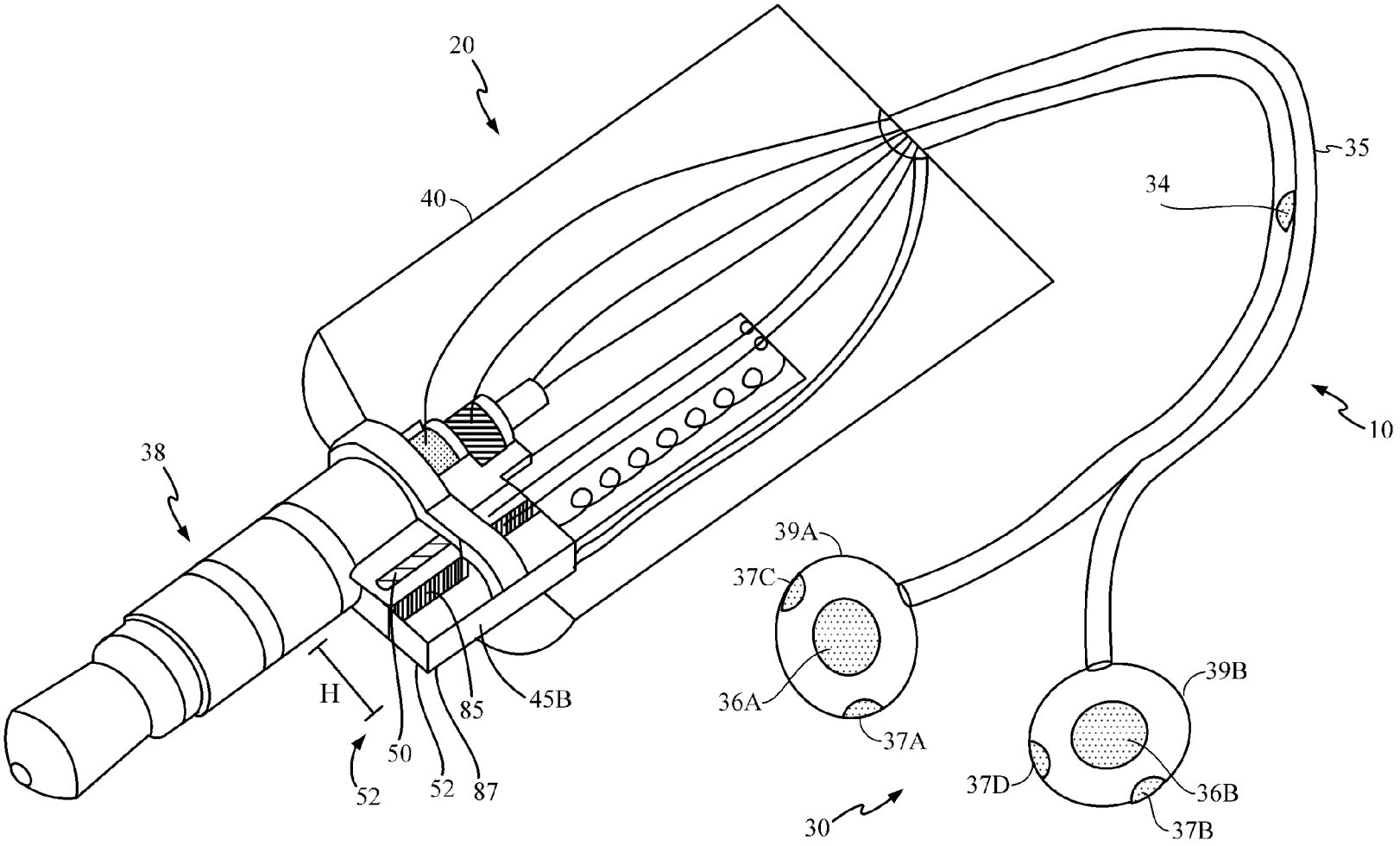
FIG. 1B is a perspective view of one embodiment of active noise cancelling headphones having four microphones in the earpieces.

As shown in FIG. 1A, a set of noise cancelling headphones 10 include a plug portion 20 and a headphone portion 30. A wire 35 connects the plug portion 20 to the headphone portion 30. The headphone portion 30 includes speakers 36A,B and microphones 37A,B. As shown in FIG. 1B, additional microphones 37C,D may be also located in the headphone portion 30, such that there are at least two microphones 37A,C or 37B,D in each earpiece 39A,B.

The plug portion 20 includes a plug 38 that has an elongated stem that is configured to mate with a matching receptacle and a plug housing 40 that includes the wires and connectors that communicate signals from the plug portion 20 to the headphone portion 30. The elongated stem of the plug 38 includes a plurality of electrical connections that connect the plug to the wires in the housing. In the embodiment shown in FIG. 1A, four electrical connections are shown on the elongated stem of the plug 38. These electrical connections may be used as terminals for the speakers 36A,B, a ground terminal, and a terminal for an additional microphone 34. This additional microphone 34 may be a lapel microphone located on the wire 35 connecting the plug portion 20 to the headphone portion 30. The additional microphone 34 may be used in capturing the sounds made by a user when speaking into a mobile device during a voice communication call. For convenience, the additional microphone 34 is called "a voice microphone".

On one side of the plug portion 20 is a retractable nub 45A that has a contact 50. It should be realized that a second contact 52 can be found on the opposite side of the nub 45A from the contact 50. The retractable nub 45A is biased by a spring 55 within a container 60 so that the nub 45A generally is positioned in the extended position as shown in FIG. 1A unless lateral pressure forces it back within the container 60 as illustrated by dashed lines 46. In this embodiment, the nub 45A provides connections to the microphones 37A,B within the headphone portion 30. These microphones can be used as part of an active noise cancelling system to reduce background noise caused by the environment surrounding a user. The embodiment shown in FIG. 1A therefore has 6 total electrical connections, including two connections for the microphones 37A,B, two connections for the speakers 36A, B, a ground terminal, and a connection for the additional microphone.

In the embodiment shown in FIG. 1B, it can be seen that a modified retractable nub 45B has an increased number of electrical connections. As shown, electrical connections 50, 85 appear on the upper surface, and electrical connections 52, 87 (not shown) are located on a lower surface. Thus, the retractable nub as described herein is not limited to having any particular number of electrical connections, but instead can be configured to have the proper number of connections required for a particular purpose. For example, the retractable nub may have 1, 2, 3, 4, 5, 6, 7, 8 or more electrical connections, in addition to the electrical connections made by the elongated stem on the plug. As shown in FIG. 1B, an additional set of two electrical connections 85, 87 allow the earpieces 39A,B to have two additional microphones 37C,D in comparison to the embodiment illustrated in FIG. 1A.

Because of the additional electrical connections 85,87 in the retractable nub 45B in the embodiment shown in FIG. 1B, the height H of the retractable nub has been increased with respect to the height of a comparable retractable nub 45A from FIG. 1A.

Returning to FIG. 1A, as can be envisioned, if pressure along force vector A is placed on the nub 45A, it will retreat into the container 60. As shown a pair of wires 65A, 65B electrically connect the contacts 50, 52 with the headphone portion 30.

Figure 2:
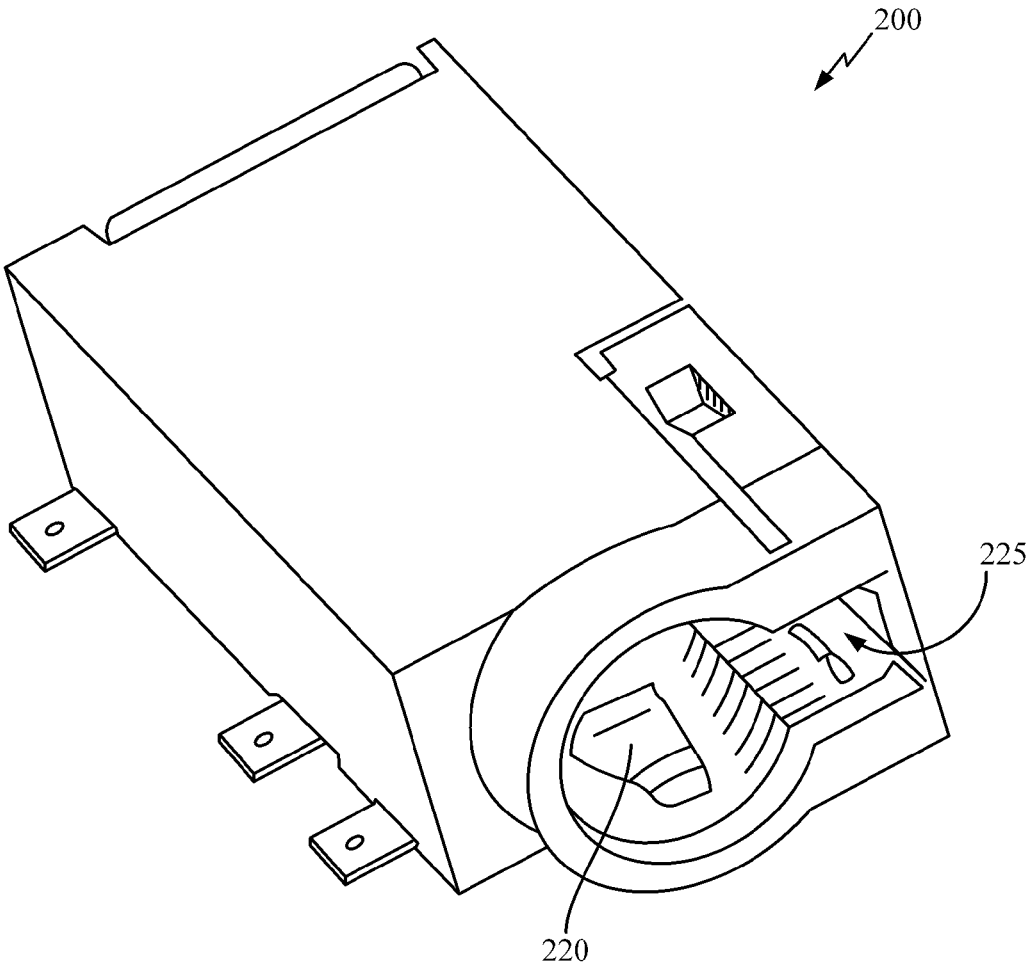
FIG. 2 is a perspective view of one embodiment of a connection port for the multi-pin connector which provides a receiving portion to connect with supplemental connectors on the multi-pin connector.

Thus, in use, if the plug portion 20 is placed within a custom receptacle, such as that shown in FIG. 2, it can be seen that the nub 45A,B would remain in its extended position and provide contact between the wires 65A,B and the receptacle though the contacts 50, 52. With reference to FIG. 2, it can be see that a plug receptacle 200 includes a circular opening 220 that is configured to mate with the plug 38. In addition, the receptacle 200 includes a rectangular opening 225 that is configured to receive the nub 45A,B and make a connection between the contacts 50, 52 on the nub and interior contacts (not shown) within the rectangular opening.

Figure 3:
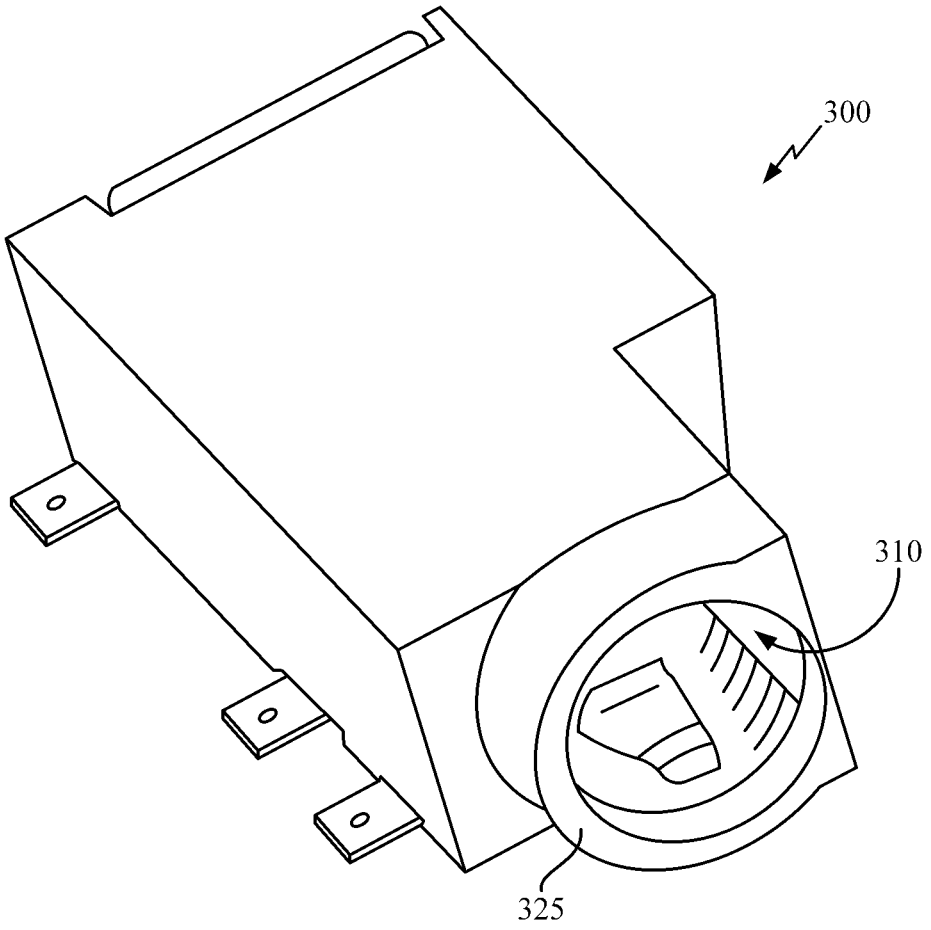
FIG. 3 is a perspective view of a conventional headphone connector that does not have a receiving portion for the supplemental connectors.

However, if the plug portion 20 is placed within a standard receptacle, such as that shown in FIG. 3, it can be seen that the nub portion 45A,B will retract back within the container 60 and thus still be plug compatible with conventional devices. For example, as shown in FIG. 3, a standard receptacle 300 includes a circular opening 310, but there is no rectangular opening that would allow the nub 45A,B to mate with electrical connections in the receptacle 300. Thus, as the plug 38 is pressed into the receptacle 300, the nub 45A,B would contact a forward edge 325 and be driven back within the container 60.

This flexibility with the plug portion 20 to be able to mate with custom receptacles such as shown in FIG. 2 and provide additional headphone connections, but still be compatible with legacy receptacles allows a user of the headphones to connect to a plurality of different devices, all of which will work properly with the headphones 10.

Of course, in devices that do not have a receptacle for the nub 45A,B, they will be limited in that because they cannot connect to the additional features of the headset 35, such as the additional microphones 37A,B and thus will not be able to use those features.

Although embodiments have been described for a headset that uses a 3.5 mm plug and compatible receptacle, the features described herein may be applicable to other plug sizes. For example, the plug could be of any diameter and be useful for a variety of purposes where it is desired to have additional connections that can be made to a custom receptacle, but also be backwards compatible with other receptacles. For example, the jack may be a $\frac{1}{8}^{th}$ inch, ¼ inch, 2.5 millimeter, or other diameter plug with a nub attached to the side.

In addition, it should be realized that the retractable nub is not limited to forming an electrical connection to only microphones inside of an earpiece of a headphone. For example, as discussed in greater detail with respect to FIGS. 8 and 9, below, the electrical connections in the nub could be used for serial data, power signals, ground signals, or a General Purpose Interface Output (GPIO), as some non-limiting examples. The serial data may include Pulse Code Modulated (PCM) signals, for example, derived from audio files. The serial data may also include control data for controlling data flow between the plug and the connected device.

In some of these embodiments, the device being connected by the retractable nub, for example the earpieces, may have their own integrated circuits that are configured to output the proper serial data, and also supply power and/or ground signals to the electrical connections on the retractable nub. Thus, for example, a powered set of intelligent headphones may have their own source of battery power, and include integrated electronics for communicating with the electrical connections on the retractable nub.

In one embodiment, the intelligent headphones may have integrated active noise cancellation processing capabilities, so that the noise cancellation is performed within the intelligent headphones instead of within the connected electronic device that is being connected to by the headphones.

Other embodiments of intelligent headphones may include integrated processors for receiving data from the device from the connections on the plug portion and the retractable nub, and processing that data. For example, the intelligent headphones may include one or more analog to digital converters for receiving analog music signals from the electronic device and converting that analog music to a different type of audio file. In another example, the music signals may be transmitted wirelessly and digitally encoded, such that analog to digital converters are not needed. Similarly, there may be other means, for example, via a USB connection by which to transfer digital files into a local memory on the intelligent headphones. In addition, the extra connections provided by the retractable nub can allow digital transmissions of a digital music file through the receptacle of an electronic device to a set of intelligent headphones. The headphones may be configurable to then play or convert the format of that digital music file within the headphones based on an integrated processor within the intelligent headphones.

Figure 4C:
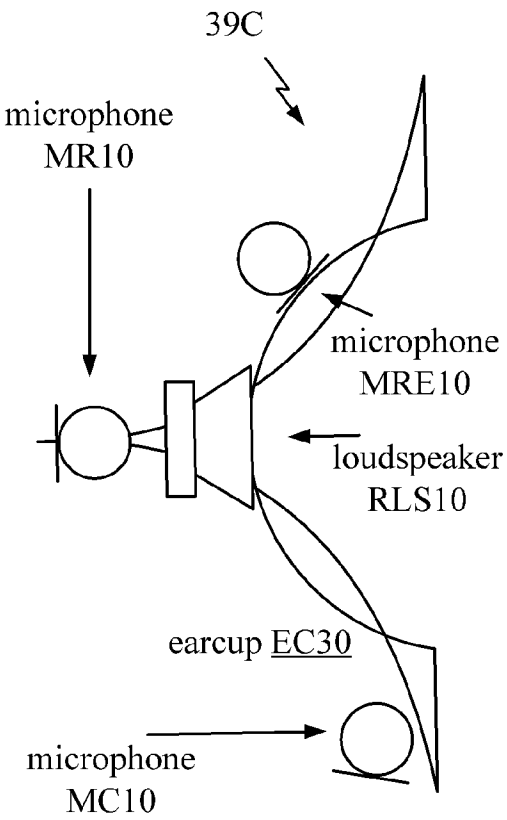
FIG. 4C is a schematic cross-sectional view of an earcup having a voice microphone in addition to a noise reference microphone and an error microphone.
Figure 4B:
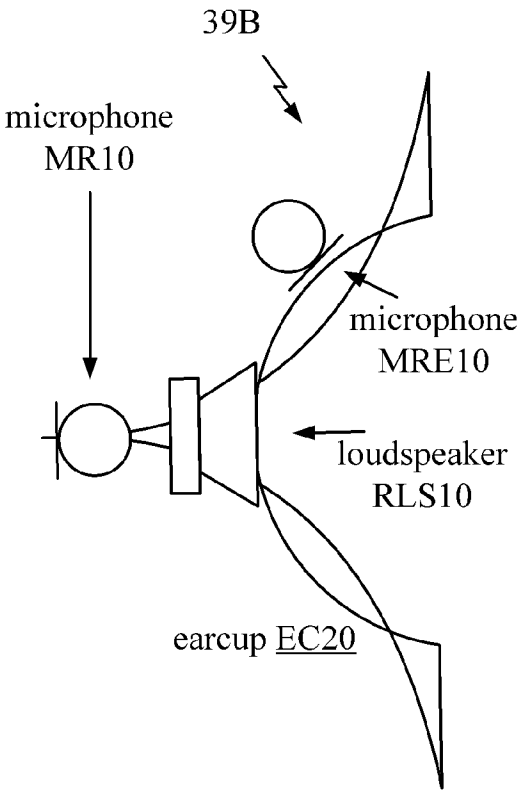
FIG. 4B is a schematic cross-sectional view of an earcup having a noise reference microphone and an error microphone.
Figure 4A:
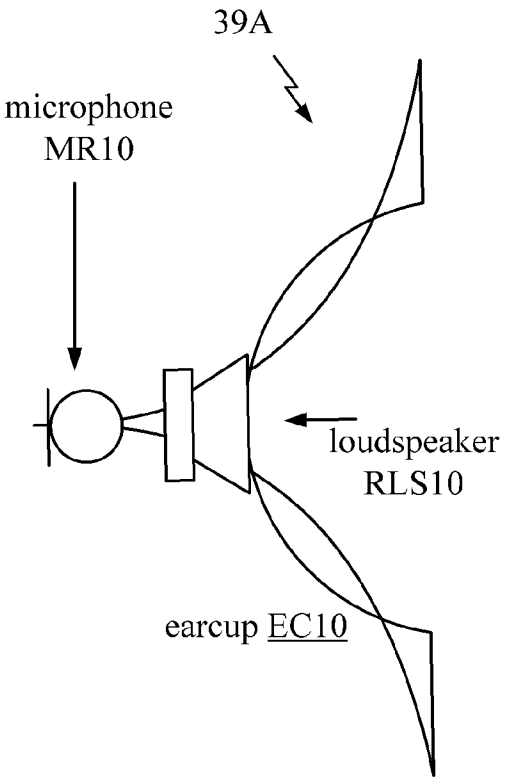
FIG. 4A is a schematic cross-sectional view of an earcup having a single noise reference microphone.

It should be noted that the earpiece described in FIG. 1A may include a noise reference microphone that is positioned closer to the outer edge of an earcup, to be directed away from the user's ear canal, as illustrated in the exemplary cross-sectional view of the earpiece 39A shown in FIG. 4A. FIG. 4A shows a cross-sectional view of an earcup EC10 that contains a right loudspeaker RLS10, arranged to produce an acoustic signal to the user's ear, and right noise reference microphone MR10 arranged to receive the environmental noise signal via an acoustic port in the earcup housing. The earcup EC10 may be configured to be supra-aural (i.e., to rest over the user's ear without enclosing it) or circumaural (i.e., to enclose the user's ear).

Figure 5B:
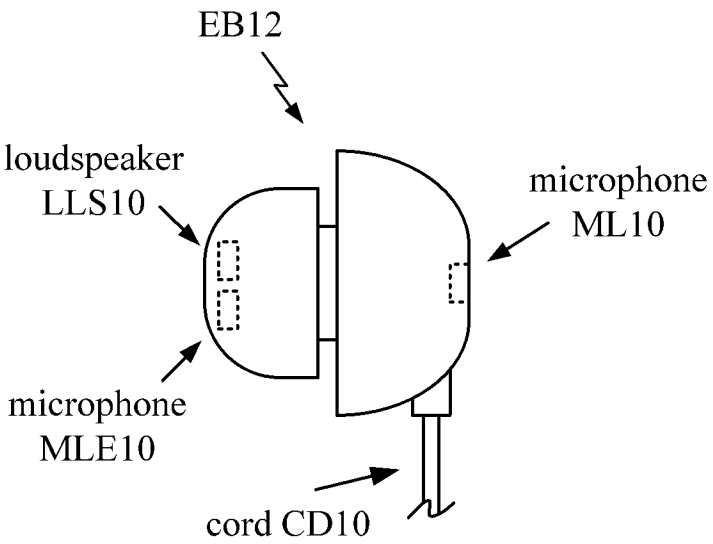
FIG. 5B is a schematic cross-sectional view of an earbud having a noise reference microphone and an error microphone.
Figure 5A:
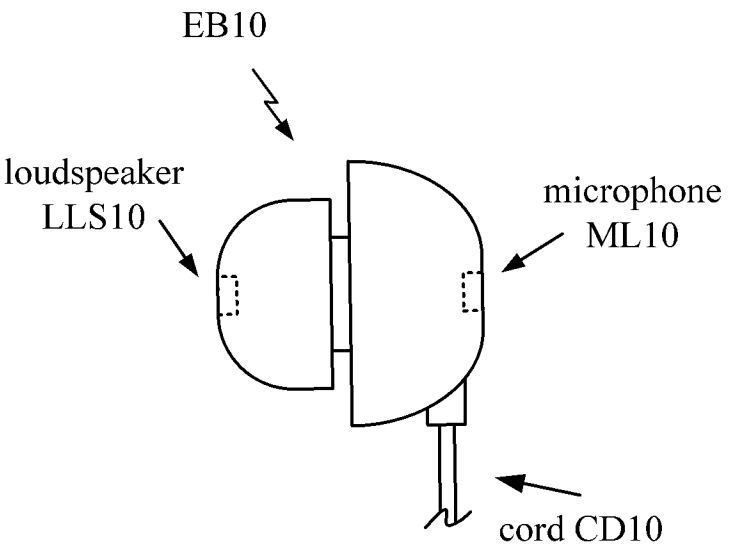
FIG. 5A is a schematic cross-sectional view of an earbud having a noise reference microphone.

As an alternative to the earcup illustrated in FIG. 4A, the earpiece may be an earbud. FIG. 5A shows a front view of an example of an earbud EB10 (now showing a portion of a left earpiece) that contains left loudspeaker LLS10 and left noise reference microphone ML10, which is positioned such that the noise reference microphone is directed away from the user's ear canal. During use, earbud EB10 is worn at the user's left ear to direct an acoustic signal produced by left loudspeaker LLS10 into the user's ear canal. It may be desirable for a portion of earbud EB10 which directs the acoustic signal into the user's ear canal to be made of or covered by a resilient material, such as an elastomer (e.g., silicone rubber), such that it may be comfortably worn to form a seal with the user's ear canal.

It should also be noted that the earpiece described in FIG. 1B may include an additional microphone (denoted as an "error microphone"). It is desirable that the error microphone be positioned closer to the inner edge of an earcup, so that the error microphone is directed closer to the user's ear canal than the corresponding noise reference microphone. FIGS. 4B and 4C illustrate exemplary cross-sectional views of the earpieces 39B and 39C having an error microphone MRE10. It may be desirable that the error microphone (whether on the left and/or right earpiece) be disposed within the acoustic field generated by the corresponding loudspeaker (left speaker and/or right speaker). For example, it may be desirable for the error microphone to be disposed with the loudspeaker be within the earcup of a headphone or an eardrum-directed portion of an earbud (as shown as error microphone MLE10 in FIG. 5B). It may also be desirable for the error microphone to be acoustically insulated from the environmental noise. It may also be desirable to insulate an error microphone (whether on the left and/or right earpiece) from receiving mechanical vibrations from the corresponding loudspeaker LLS10, RLS10 through the structure of the earbud or earcup.

FIG. 4C shows a cross-section (e.g., in a horizontal plane or in a vertical plane) of an earpiece 39C that is an implementation EC30 of earcup EC20 that also includes a voice microphone MC10 on the earcup, instead of on the wire 35 connecting the plug portion 20 to the headphone portion 30. In other implementations of earcup EC10, microphone MC10 may be mounted on a boom or other protrusion that extends from a left or right instance of earcup EC10, instead of on the wire 35 connecting the plug portion 20 to the headphone portion 30.

Figure 6:
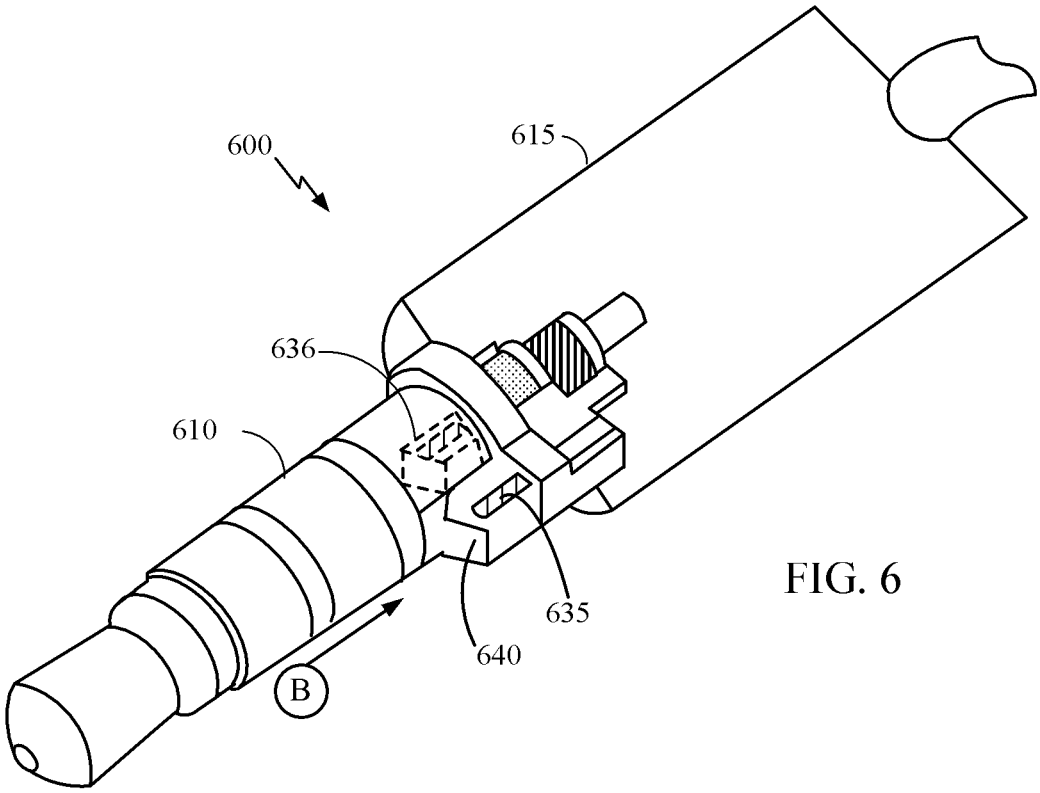
FIG. 6 is a perspective view of an alternate embodiment of active noise cancelling headphones wherein the multi-pin headphone connector has a spring loaded portion that folds into a portion of the connector.

It should also be realized that other embodiments include other mechanisms for moving the nub out of place when the plug is being placed into a legacy receptacle. For example, an alternate embodiment is shown in FIG. 6, wherein a plug portion 600 includes a plug 610 and a housing 615. As shown, an angled nub 635 is mounted along an edge of the plug 610, and in this embodiment is designed to fold into the plug 610 if pressure is placed along force vector B as shown by the dashed lines 636. The angled nub 635 includes an angled forward surface 640 that is designed so that contact with a forward edge of a receptacle, such as the forward edge 325 of receptacle 300 (FIG. 3) would cause the angled nub 635 to fold within the plug 610 and still allow the plug 610 to mount properly into a standard receptacle. However, if the angled nub 635 was mounted into a custom receptacle, such as that shown in FIG. 2, the angled nub 635 would mate within the opening 225 and make contact with the interior contacts to provide an electrical connection with the custom receptacle 200.

Other embodiments of a movable nub, or portion, that is mated to a plug are also contemplated, and thus other aspects are not only limited to the plugs shown within the present figures.

Moreover, it should be realized that devices that include the custom receptacles can be designed to provide detection circuits, modules, or software for detecting when a plug having a nub connection has been made with the device. These detection modules may, for example, be designed to detect voltage or resistance changes on the connections within the rectangular housing configured to mate with the nub. If a voltage or resistance change is detected on these contacts, the system may then begin to send signals to these contacts in order to take advantage of the electronic features that are being connected to the custom receptacle.

In one embodiment, the device is a cellular telephone and the receptacle includes additional connections for supplementary microphones as part of an active noise cancelling feature within the cellular telephone. Once a pair of headphones that has a nub portion connected to supplemental microphones is plugged into the device, it is detected by a detection circuit within the cellular telephone. The detection circuit then initializes the active noise cancelling feature on the phone and makes a connection to the supplemental microphones that are now available through the connections on the nub.

In another embodiment, the device is a tablet, laptop, or other mobile device that may be configured to make and receive voice calls, and the receptacle includes additional connections for supplementary microphones as part of an active noise cancelling feature within the tablet, laptop, or other mobile device. Once a pair of headphones that has a nub portion connected to supplemental microphones is plugged into the tablet, laptop, or other mobile device, it is detected by a detection circuit within the tablet, laptop, or other mobile device. The detection circuit then initializes the active noise cancelling feature on the phone and makes a connection to the supplemental microphones that are now available through the connections on the nub.

Figure 7A:
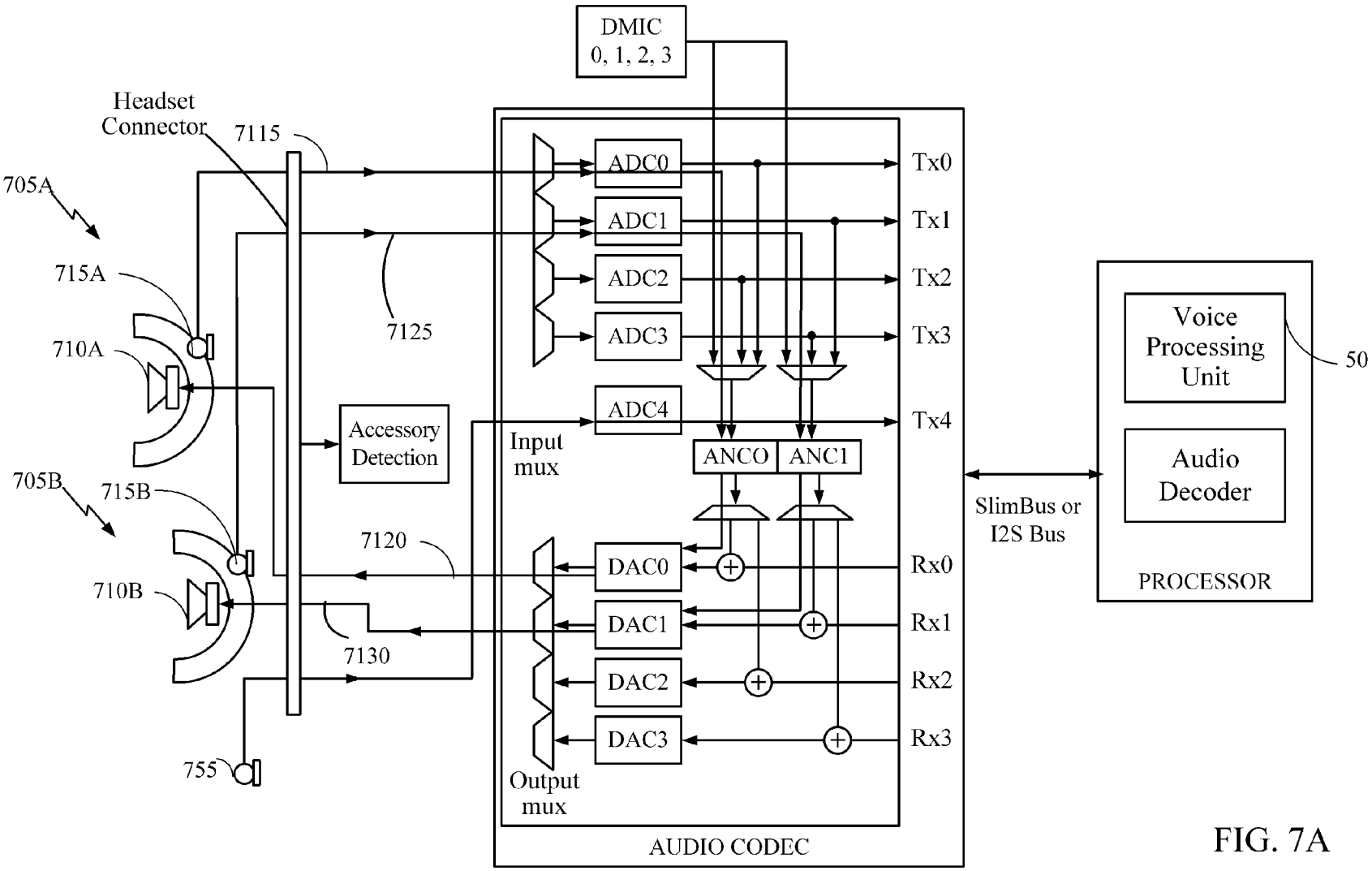
FIG. 7A is schematic illustration of a feed forward ANC configuration for a headset according to one embodiment.

One example configuration for an electronic device that has the active noise cancellation (ANC) feature is shown in FIG. 7A. FIG. 7A illustrates a feed forward ANC configuration located in a mobile device (e.g. a cellular phone, tablet, laptop or other mobile device). In such a configuration the noise reference microphones 715A, 715B of the earpieces 705A, 705B are located closer to the outer portion of each of the earpieces or earbuds as described above. The signal 7115, an ambient sound in the environment of the user of the headphones, is captured by the left (for example) noise microphone 715A in an earpiece or earbud 705A. The captured signal 7115 is converted into a digital signal by an analog-to-digital converter (ADC0) located on the mobile device, and the digital signal is used to create a digital "anti-noise" signal produced by an active noise cancellation unit (ANC0). The digital anti-noise signal is converted into an analog anti-noise signal 7120 by a digital-to-analog converter (DAC0). The analog anti-noise signal 7120 is emitted out of a left loudspeaker 710A that causes destructive interference which cancels out the signal 7115 captured by the left noise reference microphone 715A on the left earpiece or left earbud 705A.

Similarly, the right noise reference microphone 715B also captures a signal 7125 of the ambient sound in the environment. The captured signal 7125 of the right noise reference microphone 715B is converted into a digital signal by an analog-to-digital converter (ADC1) located on the mobile device, and the digital signal is used to create another second digital "anti-noise" signal produced by an active noise cancellation unit (ANC1). The second digital anti-noise signal is converted into a second analog anti-noise signal 7130 by a digital-to-analog converter (DAC1). The second analog anti-noise signal 7130 is emitted out of a right loudspeaker 710B that causes destructive interference which cancels out the signal 7125 captured by the right noise reference microphone 715B on the right earpiece or right earbud 705B.

Figure 7B:
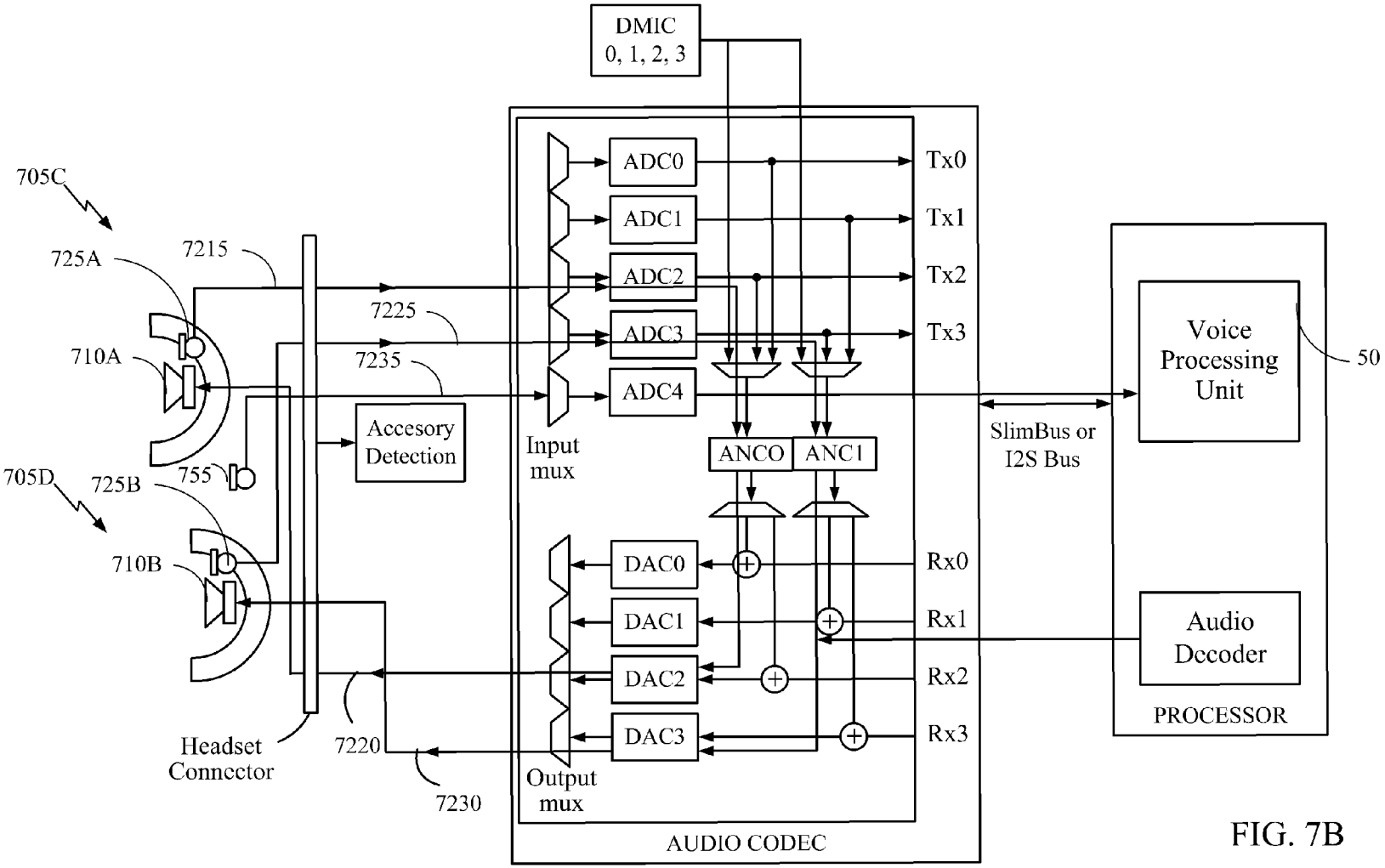
FIG. 7B is a schematic illustration of a feedback ANC configuration for a headset according to one embodiment.

Another exemplary configuration for an electronic device that has the active noise cancellation (ANC) feature is shown in FIG. 7B. FIG. 7B illustrates a feedback ANC configuration located in a mobile device (e.g. a cellular phone, tablet, laptop or other mobile device). In such a configuration, error microphones 725A, 725B are located closer to the inner portion of each of the earpieces or earbuds 705C, 705D as described above. The acoustic error signal 7215 produced by the left loudspeaker 710A is captured by the left error microphone 725A in an earpiece or earbud 705C. The captured signal 7215 is converted into a fourth digital signal by an analog-to-digital converter (ADC2) located on the mobile device, and the fourth digital signal is used to create a third digital "anti-noise" signal produced by an active noise cancellation unit (ANC0). The third digital anti-noise signal is converted into a third analog anti-noise signal 7220 by a digital-to-analog converter (DAC2). The third analog anti-noise signal 7220 is emitted out of a left loudspeaker 710A that causes destructive interference which cancels out the signal captured by the left noise reference microphone 725A on the left earpiece or left earbud 705C.

Similarly, the right error microphone 725B also captures an acoustic error signal 7225 produced by the right loudspeaker 710B which is converted into a digital signal by an analog-to-digital converter (ADC3) located on the mobile device, and the digital signal is used to create a fourth digital "anti-noise" signal produced by an active noise cancellation unit (ANC1). The fourth digital anti-noise signal is converted into a fourth analog anti-noise signal 7230 by a digital-to-analog converter (DAC3). The fourth analog anti-noise signal 7230 is emitted out of a right loudspeaker 710B that causes destructive interference which cancels out the signal captured by the right noise reference microphone 725B on the right earpiece or right earbud 705D.

In addition, the voice microphone 755 captures a signal 7235 that is converted into a digital signal by an analog-to-digital-converter (ADC4). This digital signal is sent to a voice processing unit 50. The voice processing unit 50 may be used to produce a speech packet for the user (denoted as a "near-end" user) to send to a far-end user, using a far-end mobile device (i.e., the near-end user and far-end user are in a voice communication call). The voice processing unit 50 may also be used to perform echo suppression of the near-end user, and/or perform noise reduction so the far-end user hears less noise during the conversation with the near-end user.

Figure 7C:
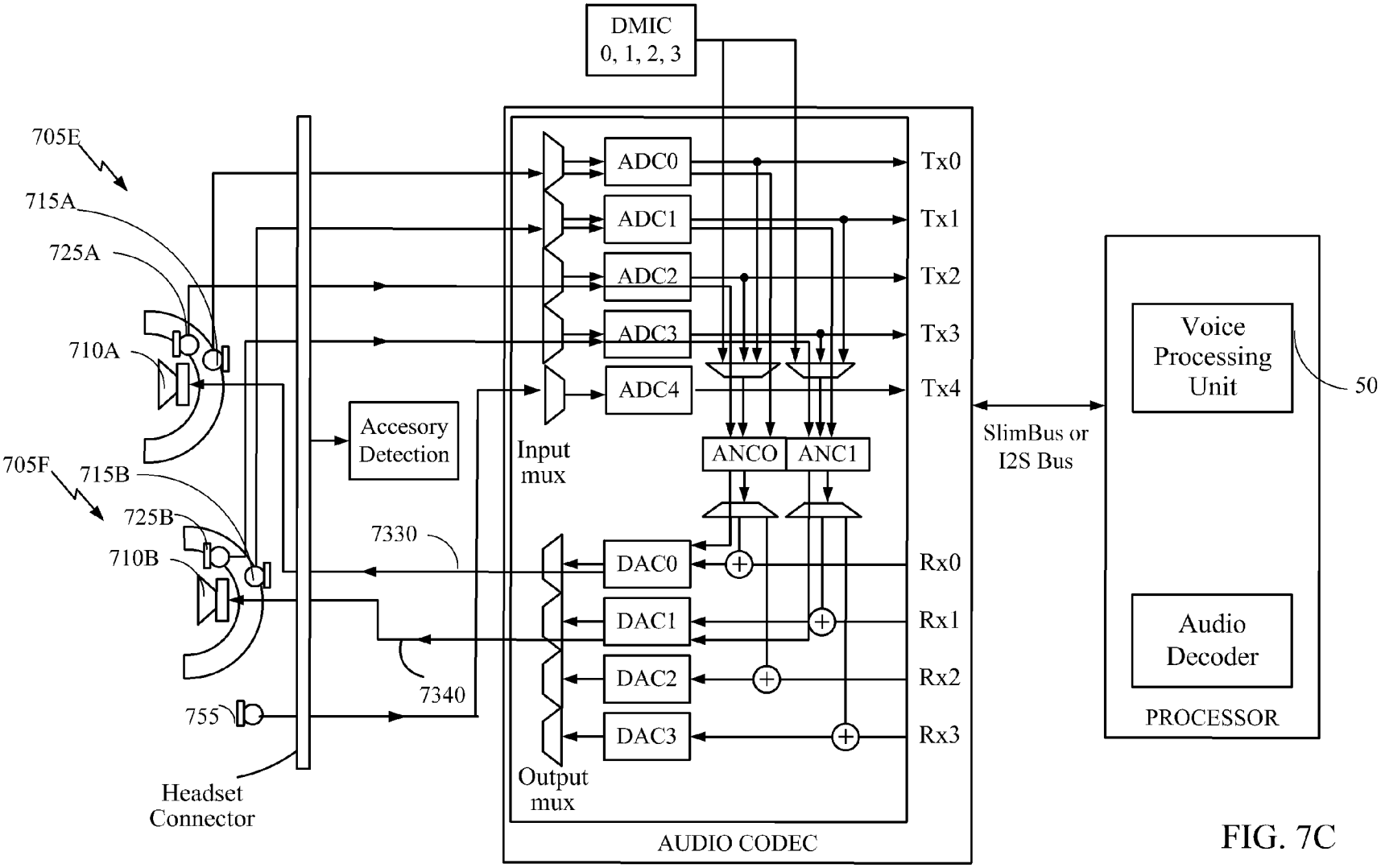
FIG. 7C is a schematic illustration of a hybrid stereo ANC configuration for a headset according to one embodiment.

Another configuration, in which an ANC system may be implemented is a combination of the configurations described in FIGS. 7A and 7B, as illustrated in FIG. 7C. In one embodiment, one ANC unit (ANC0) may generate an anti-noise signal 7330 based on the digitally converted signals from the left noise reference microphone 715A and the left error microphone 725A. The anti-noise signal 7330 is emitted at the left loudspeaker 710A in an earpiece or earbud 705E, to cancel out the ambient noise and acoustic error signal. Similarly, one ANC unit (ANC1) may generate an anti-noise signal 7340 based on the digitally converted signals from the right noise reference microphone 715B and the right error microphone 725B. The anti-noise signal 7340 is emitted from the right loudspeaker 710B in an earpiece or earbud 705F, to cancel out the ambient noise and acoustic error signal.

In a different embodiment, two ANC units may provide the active noise cancellation functionality, (i.e., there may be an ANC0*a* and ANC0*b*, not shown) that generate two anti-noise signals which are combined (e.g., added), one to cancel the ambient noise, and the other to cancel the acoustic error signal) for a left loudspeaker in an earpiece or earbud. Similarly, two ANC units may provide the active noise cancellation functionality, (i.e., there may be an ANC0*c* and ANC0*d*, not shown) that generate two anti-noise signals which are combined (e.g., added), one to cancel the ambient noise, and the other to cancel the acoustic error signal) for a right loudspeaker in an earpiece or earbud.

It should be noted that the ANC units, ANC0 and ANC1, as described in any of FIG. 7A, 7B, or 7C may be integrated into an audio codec, or may be separate units that are, directly or indirectly, coupled to an audio codec. Having the ANC units, ANC0 and ANC1, be integrated into an audio codec or as separate units that are, directly or indirectly, coupled to the audio codec, helps reduce the processing latency in producing an anti-noise signal. In contrast, the voice processing unit 50 may be located in a processor (e.g., a digital signal processor (DSP)) which may have a higher latency in processing signals as compared with the audio codec. The audio decoder may be part of the same processor as the voice processing unit or may be located in a separate processor. Other details regarding ANC operations and the voice processing unit 50 can be found, for example, in U.S. patent application Ser. No. 13/111,627, entitled "SYSTEMS, METHODS, APPARATUS, AND COMPUTER-READABLE MEDIA FOR PROCESSING OF SPEECH SIGNALS USING HEAD-MOUNTED MICROPHONE PAIR," filed on May 19, 2011.

Figure 8:
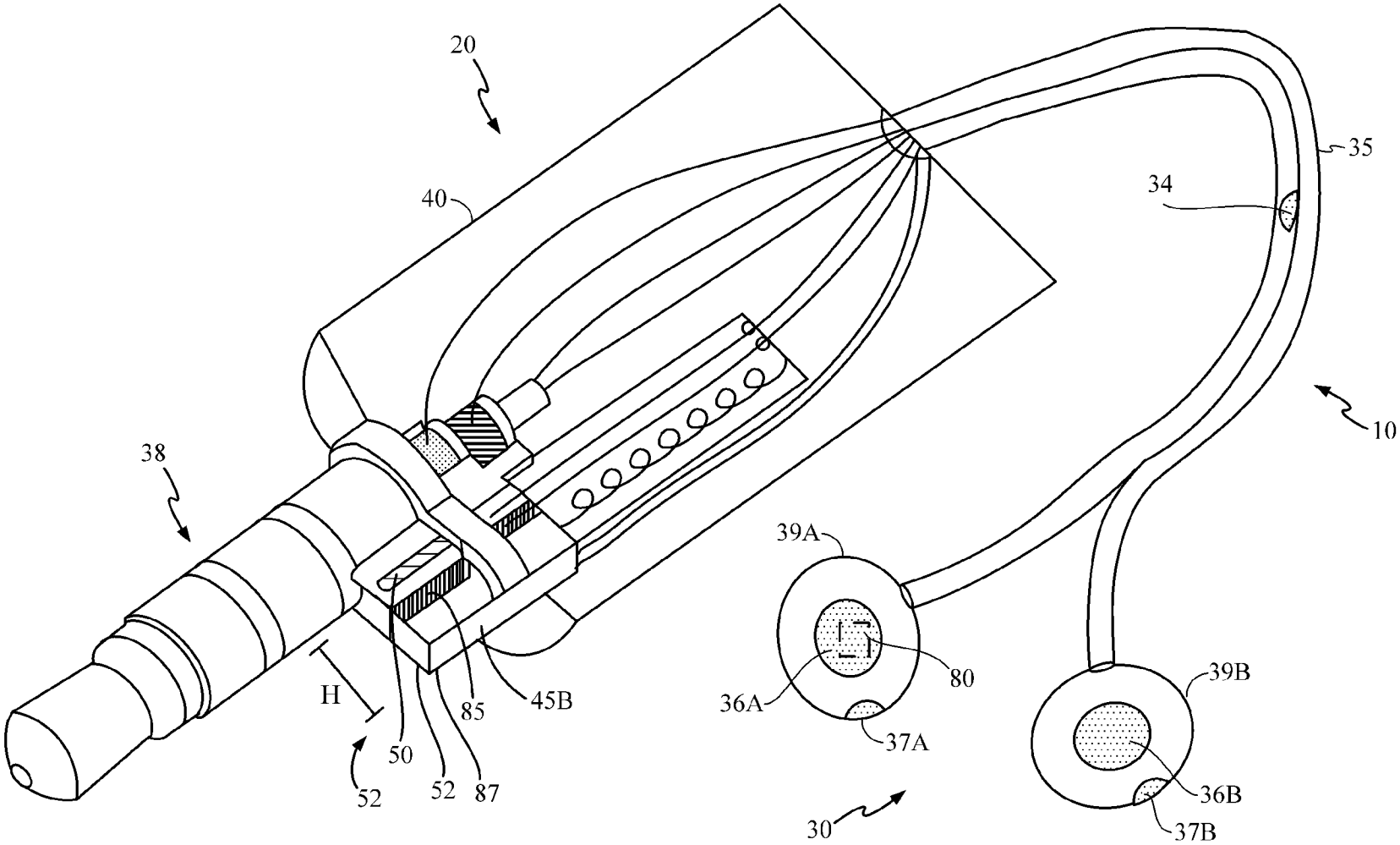
FIG. 8 is a perspective view of one embodiment of active noise cancelling headphones having an integrated circuit located within one of the earpieces.
Figure 9:
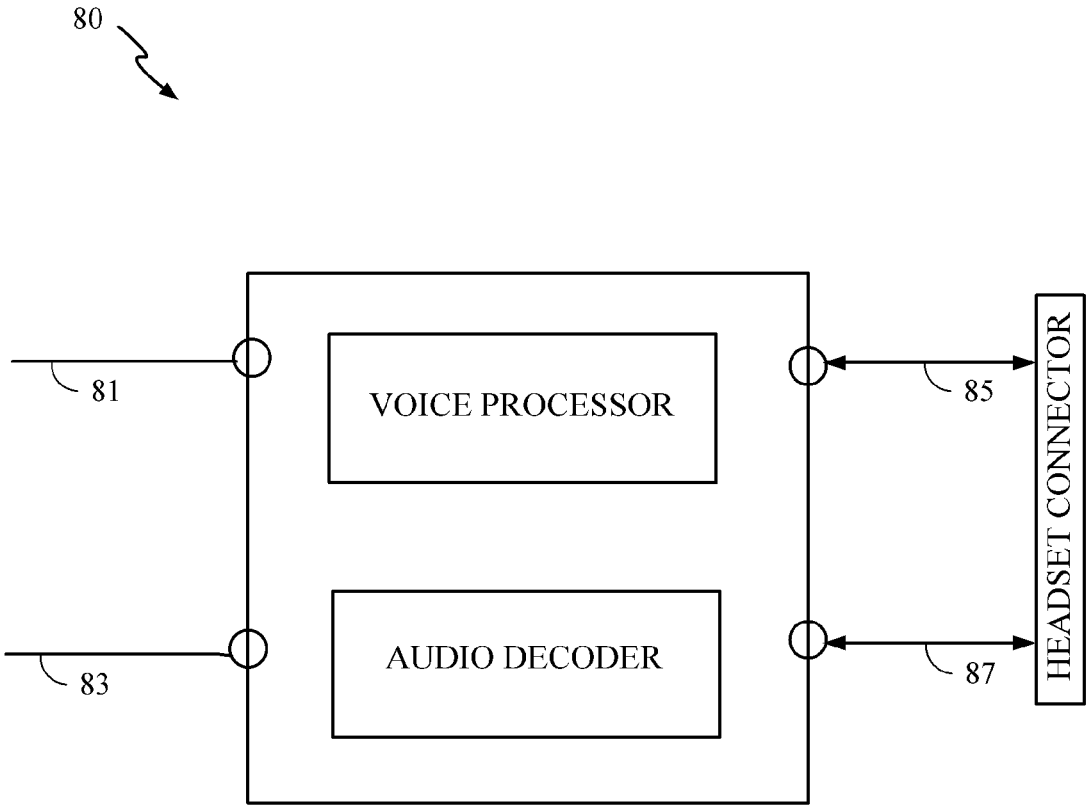
FIG. 9 is a schematic illustration of an integrated circuit that may be located within one of the earpieces of an active noise cancellation headset.

In another embodiment shown in FIG. 8, the ANC microphone lines, such as those to the error microphones 37C,D, could be replaced for serial data and power control to an integrated circuit located within one of the earpieces 39A,B. An accessory integrated circuit 80, such as that shown in FIG. 9, may be located behind the speaker 36A of earpiece 39A. In another embodiment (not shown), the accessory integrated circuit 80 may be located behind the speaker 36B of earpiece 39B. The additional set of two electrical connections 85, 87 can provide serial data and power control to the accessory integrated circuit 80 from the host. The accessory integrated circuit 80 may perform some initial processing, such as voice or audio processing. The integrated circuit 80, via electrical connections 85, 87, can send date to and receive data from the handheld electronic device host. Additional connections 81 and 83 provide ground and power connections, respectively, for the integrated circuit 80.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. References to a "direction" or "orientation" of a microphone of a multi-microphone audio sensing device indicate the direction normal to an acoustically sensitive plane of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "logarithm" is used to indicate the base-ten logarithm, although extensions of such an operation to other bases are within the scope of this disclosure. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose." Any incorporation by reference of a portion of a document shall also be understood to incorporate definitions of terms or variables that are referenced within the portion, where such definitions appear elsewhere in the document, as well as any figures referenced in the incorporated portion.

The terms "coder," "codec," and "coding system" are used interchangeably to denote a system that includes at least one encoder configured to receive and encode frames of an audio signal (possibly after one or more pre-processing operations, such as a perceptual weighting and/or other filtering operation) and a corresponding decoder configured to produce decoded representations of the frames. Such an encoder and decoder are typically deployed at opposite terminals of a communications link. In order to support a full-duplex communication, instances of both of the encoder and the decoder are typically deployed at each end of such a link.

In this description, the term "sensed audio signal" denotes a signal that is received via one or more microphones, and the term "reproduced audio signal" denotes a signal that is reproduced from information that is retrieved from storage and/or received via a wired or wireless connection to another device. An audio reproduction device, such as a communications or playback device, may be configured to output the reproduced audio signal to one or more loudspeakers of the device. Alternatively, such a device may be configured to output the reproduced audio signal to an earpiece, other headset, or external loudspeaker that is coupled to the device via a wire or wirelessly. With reference to transceiver applications for voice communications, such as telephony, the sensed audio signal is the near-end signal to be transmitted by the transceiver, and the reproduced audio signal is the far-end signal received by the transceiver (e.g., via a wireless communications link). With reference to mobile audio reproduction applications, such as playback of recorded music, video, or speech (e.g., MP3-encoded music files, movies, video clips, audiobooks, and podcasts) or streaming of such content, the reproduced audio signal is the audio signal being played back or streamed.

In the following description, specific details are given to provide a thorough understanding of the examples. However, it will be understood by one of ordinary skill in the art that the examples may be practiced without these specific details. For example, electrical components/devices may be shown in block diagrams in order not to obscure the examples in unnecessary detail. In other instances, such components, other structures and techniques may be shown in detail to further explain the examples.

It is also noted that the examples may be described as a process, which is depicted as a flowchart, a flow diagram, a finite state diagram, a structure diagram, or a block diagram. Although a flowchart may describe the operations as a sequential process, many of the operations can be performed in parallel, or concurrently, and the process can be repeated. In addition, the order of the operations may be re-arranged. A process is terminated when its operations are completed. A process may correspond to a method, a function, a procedure, a subroutine, a subprogram, etc. When a process corresponds to a software function, its termination corresponds to a return of the function to the calling function or the main function.

Those of skill in the art will understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Clarifications Regarding Terminology

Those having skill in the art will further appreciate that the various illustrative logical blocks, modules, circuits, and process steps described in connection with the implementations disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. One skilled in the art will recognize that a portion, or a part, may comprise something less than, or equal to, a whole. For example, a portion of a collection of pixels may refer to a sub-collection of those pixels.

The various illustrative logical blocks, modules, and circuits described in connection with the implementations disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or process described in connection with the implementations disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of non-transitory storage medium known in the art. An exemplary computer-readable storage medium is coupled to the processor such the processor can read information from, and write information to, the computer-readable storage medium. In the alternative, the storage medium may be integral to the processor. The processor and the storage medium may reside in an ASIC. The ASIC may reside in a user terminal, camera, or other device. In the alternative, the processor and the storage medium may reside as discrete components in a user terminal, camera, or other device.

Headings are included herein for reference and to aid in locating various sections. These headings are not intended to limit the scope of the concepts described with respect thereto. Such concepts may have applicability throughout the entire specification.

The previous description of the disclosed implementations is provided to enable any person skilled in the art to make or use the present invention. Various modifications to these implementations will be readily apparent to those skilled in the art, and the generic principles defined herein may be applied to other implementations without departing from the spirit or scope of the invention. Thus, the present invention is not intended to be limited to the implementations shown herein but is to be accorded the widest scope consistent with the principles and novel features disclosed herein.

What is claimed is:

1. A plug configured to electrically connect an apparatus to a receptacle of a device, comprising:

a plug portion having a housing, an elongated stem and one or more electrical connections on the elongated stem; and a retractable nub positioned adjacent to the plug portion and having one or more electrical connections, wherein the retractable nub is biased to move with respect to the plug portion when the plug portion is engaged into the receptacle and is configured to move inside of the elongated stem when the plug portion is engaged into the receptacle.

2. The plug of claim 1, wherein the apparatus is a set of noise cancelling headphones, and the one or more electrical connections on the nub comprise electrical connections to at least one microphone in the headphones.

3. The plug of claim 1, wherein the plug is a 3.5 mm or a 2.5 mm diameter headphone plug and wherein the retractable nub is configured to move into the elongated stem when the headphone plug is connected to a conventional 3.5 mm or a 2.5 mm headphone receptacle.

4. The plug of claim 1, wherein the plug portion has at least four electrical connections and the retractable nub has at least two electrical connections.

5. The plug of claim 1, wherein the plug portion has at least four electrical connections and the retractable nub has at least four electrical connections.

6. The plug of claim 5, wherein the retractable nub having at least four electrical connections has a greater height than a comparable retractable nub having at least two electrical connections.

7. A plug configured to electrically connect an apparatus to a compatible receptacle of a device, comprising:

means for making a first electrical connection with the receptacle, wherein the means comprises an elongated stem having one or more electrical connections; and means for retractably connecting an electronic feature of the apparatus to devices having compatible receptacles, wherein the retractable means is configured to electrically connect with devices having compatible receptacles, and is biased to move with respect to the elongated stem when engaged with incompatible receptacles and is configured to move inside of the elongated stem when the plug is engaged into the receptacle.

8. An apparatus comprising:

a headphone member having a first earpiece and a second earpiece, the first earpiece having a first speaker and a first microphone, the second earpiece having a second speaker and a second microphone; and a plug operably connected to the headphone member having a first electrical connection configured to output a first signal, based on a signal captured by the first microphone, to an external electronic device, a second electrical connection configured to output a second signal, based on a signal captured by the second microphone, to the external electronic device, a third electrical connection configured to output a third signal, based on a signal captured by a third microphone, to the external electronic device, and a fourth electrical connection configured to output a fourth signal based on a signal captured by a fourth microphone;

wherein the first and second electrical connections are located on a retractable portion of the plug configured to retractably connect an electronic feature of the apparatus to devices having compatible receptacles, wherein the retractable portion is configured to electrically connect with devices having compatible receptacles, and is biased to move with respect to the elongated stem when engaged with incompatible receptacles.

9. The apparatus of claim 8, wherein the first signal is an ambient signal and the second signal is an ambient signal.

10. The apparatus of claim 8, wherein the first signal is an acoustic error signal and the second signal is an acoustic error signal.

11. The apparatus of claim 8, wherein the first and second microphones are noise reference microphones.

12. The apparatus of claim 8 further comprising a fifth electrical connection configured to output a fifth signal based on a signal captured by a fifth microphone, wherein the signals captured by the fourth and fifth microphones are acoustic error signals.

13. The apparatus of claim 12, wherein the fourth and fifth electrical connections are located on a retractable portion of the plug.

14. An apparatus comprising:

a headphone member having a first earpiece and a second earpiece, the first earpiece having a first speaker and a first microphone, the second earpiece having a second speaker and a second microphone; and a plug operably connected to the headphone member having a first electrical connection configured to output a first signal, based on a signal captured by the first microphone, to an external electronic device, a second electrical connection configured to output a second signal, based on a signal captured by the second microphone, to the external electronic device, a third electrical connection configured to output a third signal, based on a signal captured by a third microphone, to the external electronic device; a fourth electrical connection configured to output a fourth signal to the external electronic device, and a fifth electrical connection configured to output a fifth signal to the external electronic device;

wherein the first, second, third, and fourth electrical connections are located on a retractable portion of the plug configured to retractably connect an electronic feature of the apparatus to devices having compatible receptacles, wherein the retractable portion is configured to electrically connect with devices having compatible receptacles, and move with respect to the elongated stem when engaged with incompatible receptacles.

15. The apparatus of claim 14, wherein the third signal is a serial data signal from an integrated circuit located within the first earpiece.

16. The apparatus of claim 14, wherein the fourth signal is a serial data signal from an integrated circuit located within the second earpiece.

* * * * *